US005682079A

United States Patent [19]

Kang

[11] Patent Number: 5,682,079

[45] Date of Patent: Oct. 28, 1997

[54] PHOSPHOR LAYER STRUCTURE OF A CCRT

[75] Inventor: Seoug Wan Kang, Kyungsangbuk-do, Rep. of Korea

[73] Assignee: LG Electronics Inc., Seoul, Rep. of Korea

[21] Appl. No.: 514,101

[22] Filed: Aug. 11, 1995

[30] Foreign Application Priority Data

Aug. 11, 1994 [KR] Rep. of Korea ..... 19813/1994

[51] Int. Cl.[6] ..... H01J 29/10

[52] U.S. Cl. ..... 313/461; 313/463; 313/473

[58] Field of Search ..... 313/461, 463, 313/467, 473

*Primary Examiner*—Sandra L. O'Shea
*Assistant Examiner*—Vip Patel
*Attorney, Agent, or Firm*—Fish & Richardson P.C.

[57] ABSTRACT

A phosphor layer structure of a color cathode ray tube in a screen formed of a block matrix and red, green and blue phosphors is suitable for improving white luminance, in which $\tau>\alpha$, $\tau>\beta$ and $\alpha\beta\alpha/\tau$, and $\alpha/\tau=0.91\sim0.65$ providing that a width occupied by the red phosphor is designated by $\alpha$, that occupied by the blue phosphor is $\beta$ and that occupied by the green phosphor is $\tau$.

2 Claims, 2 Drawing Sheets

PHOSPHOR LAYER STRUCTURE OF A CCRT

BACKGROUND OF THE INVENTION

1. Field of the Invention

The present invention relates to a color cathode ray tube, and more particularly to a phosphor layer structure of a color cathode ray tube suitable for improving white luminance. 2. Description of the Prior Art Generally, cathode ray tubes (i.e., Brawn tubes) are employed by television receivers or a variety of monitors to reproduce a color picture by activating red, green and blue phosphors to emit light by means of video signals (luma signals and color signals). As illustrated in FIG. 1, a cathode ray tube is formed of a panel 1 incorporated with a funnel 9 having a neck 10 at the rear thereof to have an external appearance of a bulb form. An electron gun is installed within neck 10 to emit three electron beams 7 of red, green and blue. A deflection yoke 6 is installed along the outer circumference of neck 10 of funnel 9 to deflect electron beams 7 from the electron gun in the horizontal and vertical direction. A mask frame 4 is supported by a plurality of supporting springs in the interior of panel 1. Also, toward panel 1 of mask frame 4, a shadow mask 3 is fixed by being perforated to have a lot of small apertures to allow electron beams 7 from the electron gun to pass through them. Toward funnel 9 of mask frame 4, an inner shield 5 is fixed for preventing electron beams 7 emitted from the electron gun from being deformed during the progression caused by the terrestrial magnetic field or leakage magnetic field. In the inner side of panel 1, a phosphor layer 2 is formed by being coated with the phosphors to form an image when electron beams 7 having passed through shadow mask 3 strike thereto.

Here, the phosphor layer of the conventional color cathode ray tube is formed such that a black matrix layer for absorbing light by distinguishing a pixel portion consisting of red, green and blue phosphors that reproduces color information of red, green and blue from an adjacent portion (between a pixel and a pixel) is formed of graphite.

In other words, the phosphor layer for functioning by reproducing the color image to make it visible to a viewer, which is the ultimate object of the color cathode ray tube, is coated with red, green and blue phosphor pixels having a spectrum of emitting three primary colors of light that converts a video signal received as an electric signal into a visible signal, and the graphite being a light-absorbing material, which are separately distributed on the inner surface of the glass of panel 1 via photolithography.

A process of fabricating the phosphor layer constructed as above can be largely divided into a black matrix coating step of coating the light-absorbing black material and a phosphor coating step of coating the three phosphor pixels.

The process will be described in detail below.

After cleaning and drying the panel, a photoresist is coated onto the panel and dried, which is then exposed and developed by three colors, so that a black matrix area and a pixel area are defined. A graphite is coated on the whole surface of the resultant structure to be etched via a lift-off method, thereby forming the black matrix layer. At this time, by performing the etching via the lift-off method, the photoresist, photoresist where the photoresist overlaps the graphite, and graphite are selectively removed.

After the panel formed with the black matrix layer is cleaned with warm water and pure water, and precoated for preventing the adhesion and diffused reflection, the green phosphor is coated on the whole surface of the resultant structure. Then, the resulting structure is exposed and developed to form the green phosphor G at a green pixel area among the pixel areas. The blue phosphor B and red phosphor R are formed on corresponding portions in the same way.

Successively, an emulsion coating is carried out on the whole surface thereof, and an aluminum process is performed to fabricate the phosphor layer.

The phosphor layer structure (e.g., the stripe type) formed via the black matrix and phosphor processes is as shown in FIG. 2.

That is, the widths m of green, red and blue phosphors G, R and B are provided to be the same as one another, and a ratio of width m of phosphors G, R and B to the width l of black matrix BM is roughly 3:2.

The phosphor layer of the conventional color cathode ray tube formed as above, a black material such as the graphite having the excellent light-absorption property is coated around the phosphor dots or stripes, so that unnecessary external light is decreased to improve contrast.

However, the phosphor layer structure of the conventional color cathode ray tube formed as above involves the following problem.

More specifically, the red, green and blue phosphors of a certain size are formed between the black matrix layers to be luminous by the electron beams, thereby obtaining a desired color. But it is designed that the widths of the coated red, green and blue phosphors are the same as one another in spite of the fact that the green phosphor among the luminous phosphors of red, green and blue occupies approximately 70% or more in a luminance rate during the white luminance, so that it is restricted in increasing the luminance.

SUMMARY OF THE INVENTION

The present invention is devised to solve the above-described problem. Accordingly, it is an object of the present invention to provide a phosphor layer structure of a color cathode ray tube for varying to improve the widths of red, green and blue phosphors to enhance white luminance.

To achieve the above object of the present invention, there is provided a phosphor layer structure of a color cathode ray tube in a screen formed of a block matrix and red, green and blue phosphors is formed such that $\gamma>\alpha$, $\gamma>\beta$, $\alpha\geqq\beta$, $\alpha/\gamma=0.91-0.65$ and $\beta/\gamma=0.91-0.65$; providing that a width occupied by the red phosphor is designated by $\alpha$, that occupied by the blue phosphor is $\beta$ and that occupied by the green phosphor is $\gamma$.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Figure 1:
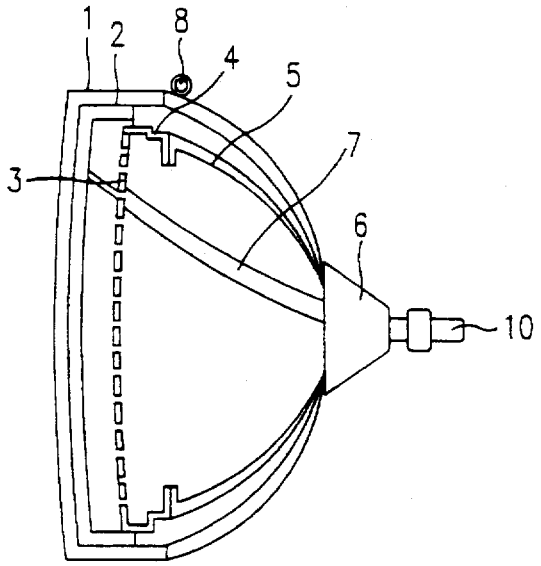
FIG. 1 is a vertical section view showing a general color cathode ray tube.
Figure 2:
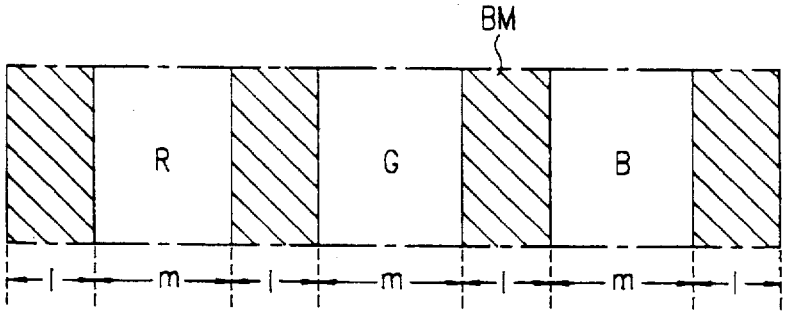
FIG.2 PRIOR ART
FIG. 2 is a plan view showing a conventional structure of the phosphor layer of the conventional color cathode ray tube.
Figure 3:
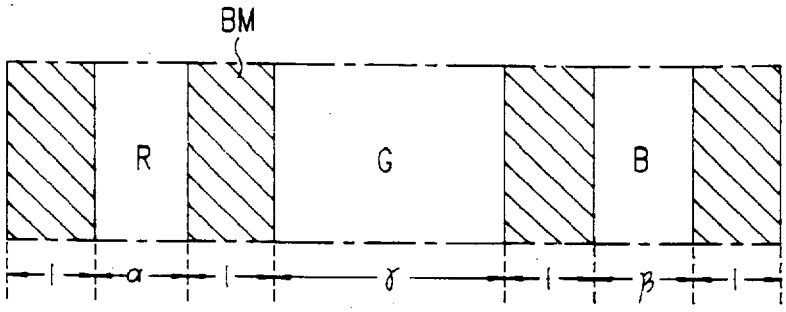
FIG. 3 is a plan view showing a structure of a phosphor layer of a color cathode ray tube according to one embodiment of a present invention.
Figure 4:
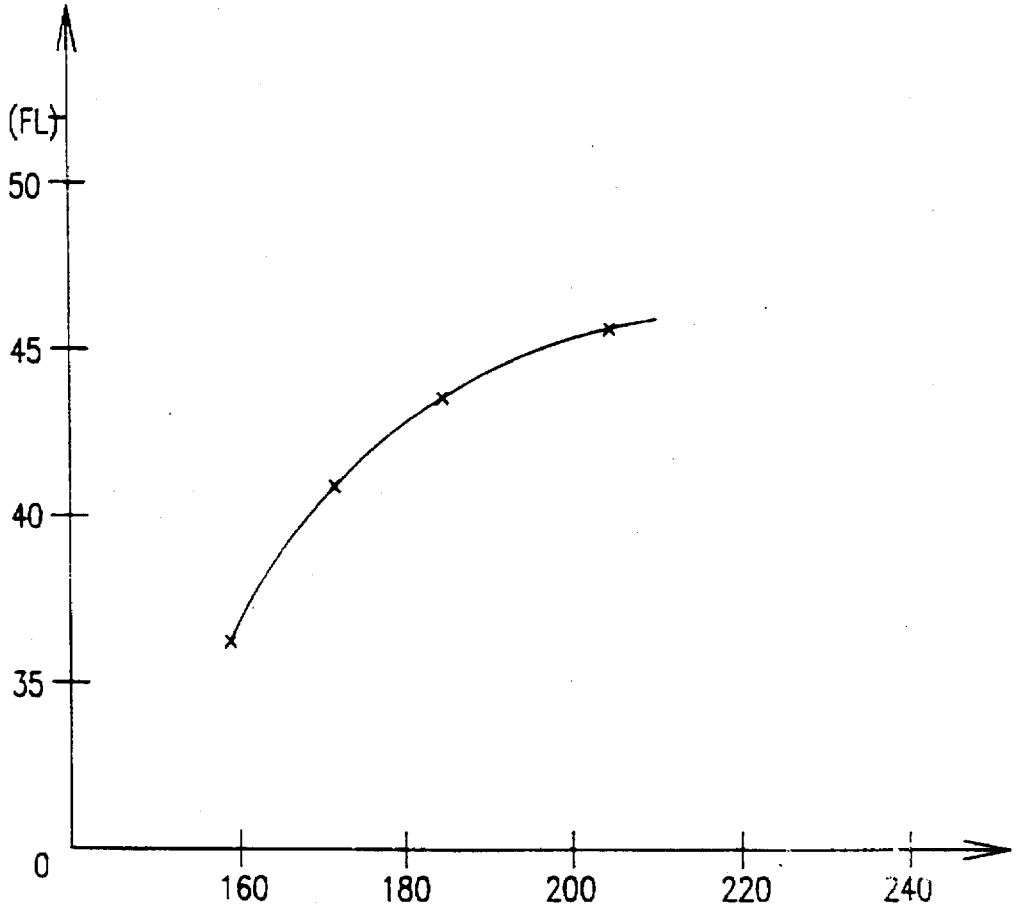
FIG. 4 is a graph representation for plotting the white luminance variation in accordance with varying the width of the green phosphor layer.

FIG. 3 is a plan view showing the phosphor layer structure of a color cathode ray tube according to one embodiment of the present invention.

Here, areas (widths) occupied by red, green and blue phosphors are formed to differ from one another not to be identical to one another during the formation of a black matrix for forming a pattern of a screen of the color cathode ray tube. In more detail, a width α occupied by the red phosphor R and a width β occupied by the blue phosphor B are designed to be smaller than those of the conventional phosphors by 3~15%, and a width γ occupied by the green phosphor G is designed to be larger than that of the conventional one by 6–15%.

Widths α and β reduced as many as 0–3% and width γ increased as many as 0–6% cannot significantly affect luminance. Widths α and β reduced 15% or below and width τ increased 30% or more can improve white luminance but results in poor landing characteristic.

Therefore, the mutual relation of widths α, β and γ occupied by red, green and blue phosphors R, G and B are as follows. That is, it is formed such that $\alpha/\gamma=0.91–0.65$ and $\beta/\gamma=0.91–0.65$ under the provisions that $\gamma>\alpha$, $\gamma>\beta$, and $\alpha\geqq\alpha$.

The phosphor layer structure of the color cathode ray tube according to the present invention will be described by means of experimental data as below.

In the three-color exposure step for defining the black matrix area via the process the same as the conventional one, the width of the black matrix is approximately 90 μm and the widths of the red, green and blue phosphors are identically formed to be approximately 160 μm in the same conditions of the conventional phosphor layer structure. Whereas, the width of the black matrix is approximately 90 μm, that of the red phosphor is 145 μm, that of the green phosphor is 190 μm and that of the blue phosphor is 140 μm in accordance with the conditions of the phosphor layer structure according to the present invention. The result of this experiment is represented in [Table] attached below.

TABLE

| | Conventional phosphor layer structure | | | | Phosphor layer structure of the present invention | | | |
|---|---|---|---|---|---|---|---|---|
| Class | R | B | G | White luminance | R | B | G | White Luminance |
| Luminance | $6.^{92}$ | $2.^{42}$ | $27.^{80}$ | $37.^{3}$ | $6.^{03}$ | $2.^{12}$ | $36.^{33}$ | $44.^{5}$ |

*Experiment condition: 1300 μm, measuring point: center

As can be noted in the above experiment data, the effect of enhancing the white luminance is about 20%.

The phosphor layer structure according to the present invention as described above is advantageous in that the color cathode ray tube has an excellent luminance improved by approximately 10–40% over the conventional one while maintaining the similar contrast by forming the width of the green phosphor to be larger than those of the red and blue phosphors without forming them to be the same as one another.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A phosphor layer of a color cathode ray tube comprising, a black matrix and red, blue and green phosphors, the phosphor layer structure of said color cathode ray tube being formed such that $\alpha/\gamma=0.91–0.65$ and $\beta/\gamma=0.91–0.65$ under provisions $\gamma/>\alpha$, $\gamma>\beta$ and $\alpha\geqq\beta$ providing that a width occupied by said red phosphor is designated by α, that occupied by said blue phosphor is β and that occupied by said green phosphor is γ.

2. A phosphor layer structure of a color cathode ray tube as claimed in claim 1, wherein a width of said black matrix is consistently designed.

* * * * *